US008002322B2

(12) United States Patent
Rathmell et al.

(10) Patent No.: US 8,002,322 B2
(45) Date of Patent: Aug. 23, 2011

(54) MULTI-USE SNOW TOOL

(75) Inventors: Brian Rathmell, Hood River, OR (US); Benjamin Bliesner, Rhododendron, OR (US)

(73) Assignee: Cascade Alpine, LLC, Hood River, OR (US)

( * ) Notice: Subject to any disclaimer, the term of this patent is extended or adjusted under 35 U.S.C. 154(b) by 433 days.

(21) Appl. No.: 12/168,344

(22) Filed: Jul. 7, 2008

(65) Prior Publication Data

US 2009/0021032 A1 Jan. 22, 2009

Related U.S. Application Data

(60) Provisional application No. 60/959,592, filed on Jul. 16, 2007.

(51) Int. Cl.
*A01D 11/00* (2006.01)

(52) U.S. Cl. ..... 294/51; 254/131; 7/116; 30/169

(58) Field of Classification Search ..... 294/51, 294/53.5, 54.5, 59; 254/130, 131, 25, 21; 7/116; 30/167, 169, 172, 351, 353, 356, 30/357

See application file for complete search history.

(56) References Cited

U.S. PATENT DOCUMENTS

| | | | | |
|---|---|---|---|---|
| 3,404,412 | A | 10/1968 | Ryan | |
| 3,473,712 | A | 10/1969 | Genchi | |
| 3,803,648 | A | 4/1974 | King, III | |
| 4,118,050 | A | 10/1978 | Schnurrenberger | |
| 4,323,265 | A | 4/1982 | Benner | |
| 4,700,420 | A | 10/1987 | Belanger | |
| 4,705,290 | A | 11/1987 | Gratz et al. | |
| 5,060,997 | A * | 10/1991 | Plecki | 294/50.6 |
| 5,345,635 | A | 9/1994 | Morgan | |
| D365,264 | S | 12/1995 | Morgan | |
| 5,527,077 | A * | 6/1996 | Bickar | 294/52 |
| 5,887,920 | A * | 3/1999 | Perciful | 294/57 |
| 6,003,915 | A | 12/1999 | Bierman | |
| 6,158,791 | A * | 12/2000 | Drew | 294/54.5 |
| 6,357,067 | B1 | 3/2002 | Jones | |
| 6,378,153 | B1 | 4/2002 | Morgan | |
| 6,711,772 | B2 | 3/2004 | Grassi | |
| 6,746,062 | B2 * | 6/2004 | Bielecki et al. | 294/7 |
| 6,869,118 | B2 * | 3/2005 | Bradford | 294/51 |
| 7,219,382 | B2 | 5/2007 | Johnson | |
| 7,293,361 | B1 * | 11/2007 | Miller | 30/164.6 |
| 2007/0108782 | A1 | 5/2007 | Walker et al. | |

OTHER PUBLICATIONS

ISA Korea; International Search Report of PCT/US2008/069300; Nov. 13, 2008; WIPO.

* cited by examiner

*Primary Examiner* — Saúl J Rodríguez
*Assistant Examiner* — Stephen Vu
(74) *Attorney, Agent, or Firm* — Alleman Hall McCoy Russell & Tuttle LLP

(57) ABSTRACT

A multi-use snow tool is described, which includes a snow fluke and a snow picket that may be combined to function as a snow shovel, or may be used independent of each other as climbing anchors. As one example, the multi-use snow tool includes a snow fluke including a blade body having a base end and a nose end opposite the base end; a snow picket having an elongate shaft including at least a first flange; and a lip assembly located at the base end of the blade body and cooperating with the blade body to define at least a first channel that is adapted to mate with the first flange to detachably couple the snow picket to the snow fluke.

13 Claims, 7 Drawing Sheets

126
182
1110
180
128
618
124
114
160
162
112
166
150
118
130
121
181
110
164
116
168
11
120
182
180
124
122
100
128
126
123
140
184
170
186
142

MULTI-USE SNOW TOOL

CROSS REFERENCE TO RELATED APPLICATIONS

The present application claims priority to U.S. Provisional Patent Application No. 60/959,592, filed Jul. 16, 2007, the entire contents of which are incorporated herein by reference.

TECHNICAL FIELD

The present disclosure relates to a multi-use snow tool for use in climbing or mountaineering.

BACKGROUND

Climbers and mountaineers may utilize a variety of tools while engaging in climbing or rescue activities. Climbing anchors such as snow flukes or snow pickets may be used in environments containing ice or snow to protect the climber by restraining or arresting their fall. For example, snow pickets may include a stake or spike that may be driven into the ice or snow by the climber. Snow flukes, which typically have broader surfaces than snow pickets, may also be inserted into the ice or snow. Some climbers choose to carry both snow pickets and snow flukes when conducting climbing or rescue activities since they may each provide a superior anchoring function under different conditions. Climbers may utilize still other tools, such as a snow shovel that may be used to assist with digging in ice or snow. For example, a snow shovel may be used to conduct a variety of digging activities such as constructing snow shelters, rescuing avalanche victims, and conducting avalanche testing.

SUMMARY

The inventors herein have recognized some disadvantages associated with these several tools. As one example, some climbers may choose not to carry one or more of the snow fluke, snow picket, or snow shovel in order to reduce the total weight of the equipment that they carry on their climbing excursion. Furthermore, the inventors herein have also recognized that some climbers may choose not to purchase one or more of these tools in order to reduce their total expenditure on climbing equipment. However, where a climber chooses not to carry one or more of these tools, the climber forgoes the specific benefits associated with the tool.

As a non-limiting example, some of these issues may be addressed by a multi-use snow tool, which includes a snow fluke and a snow picket that may be combined to function as a snow shovel, or may be used independent of each other as climbing anchors. As one example, the multi-use snow tool comprises a snow fluke including a blade body having a base end and a nose end opposite the base end; a snow picket having an elongate shaft including at least a first flange; and a lip assembly located at the base end of the blade body and cooperating with the blade body to define at least a first channel that is adapted to mate with the first flange to detachably couple the snow picket to the snow fluke.

This Summary is provided to introduce a selection of concepts in a simplified form that are further described below in the Detailed Description. This Summary is not necessarily intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figures 1, 11:
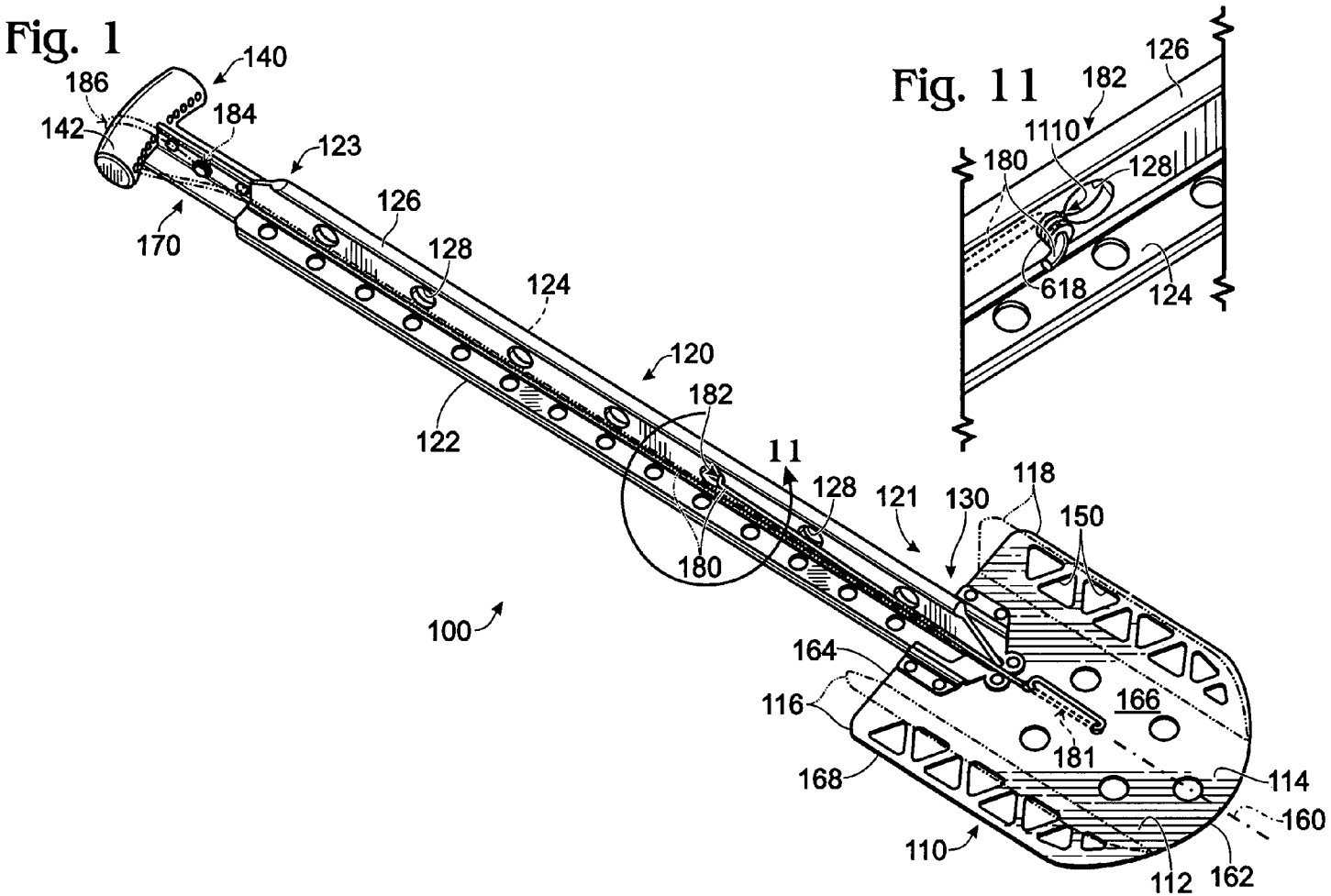
FIG. 1 shows an example embodiment of a reconfigurable multi-use snow tool including a snow fluke and a snow picket.
FIG. 11 shows a detailed view of the example embodiment of FIG. 1.

FIG. 1 shows an example embodiment of a reconfigurable multi-use snow tool 100. Reconfigurable multi-use snow tool 100 may include two or more distinct tools that cooperate with each other to function as a snow shovel by combining at least a snow fluke 110 and a snow picket 120 at a first interface 130. As depicted in FIG. 1, snow fluke 110 can serve as a shovel blade and snow picket 120 can serve as a shovel arm that collectively cooperate to facilitate a digging activity.

Snow fluke 110 and snow picket 120 may be selectively separated from each other at first interface 130, where they may be used independent of each other as climbing anchors for use in ice or snow. For example, snow fluke 110 may be partially or completely buried in snow or ice, where it may function as an anchor to which climbing gear such as ropes, webbing, and carabiners may be secured. Similarly, snow picket 120 may be partially or completely buried in snow or ice, where it may also function as an anchor to which climbing gear such as ropes, webbing, and carabiners may be secured. In this way, snow fluke 110 and snow picket 120 may be used independent of each other to provide a first function, and may be used collectively with each other or in combination to provide a second function that is different from the first function.

Snow fluke 110 includes a blade body 112, which may be of any suitable size and shape that enables the snow fluke to function as both a shovel blade and a climbing anchor. In some embodiments, blade body 112 may comprise a thin plate that is substantially broad in two dimensions as depicted by first outwardly facing surface 166, and may be substantially narrow in a third dimension as depicted with reference to edge 168. As a non-limiting example, edge 168 may have a thickness of approximately ⅛ inch, may have a length of approximately 8-12 inches in length as measured along central axis 160, and a width of approximately 5-9 inches. However, snow fluke 110 may have other suitable sizes and shapes.

In some embodiments, blade body 112 may be substantially flat or planar as depicted in FIG. 1. In other embodiments, blade body 112 may be non-planar. For example, as depicted by broken lines in FIG. 1, blade body 112 may include a central portion 114 and two wing portions 116 and 118, which may be disposed on each side of the central portion. Wing portions 116 and 118 may be angled or bent inward toward first outwardly facing surface 166 of central portion 114. In still other examples, blade body 112 may curve inward toward outwardly facing surface 166 rather than having discrete planar or substantially planar blade body portions. In this way, blade body 112 of snow fluke 110 can form a shovel blade or scoop that facilitates digging when used in combination with snow picket 120.

In some embodiments, blade body 112 may be substantially symmetric about a central axis 160, which extends between a nose end 162 and a base end 164 of snow fluke 110. For example, wing portions 116 and 118 may disposed symmetrically about central axis 160. In at least some examples, nose end 162 of blade body 112 may be tapered inward or pointed toward central axis 160 to enable nose end 162 of snow fluke 110 to more easily penetrate ice or snow. Blade body 112 may comprise any suitable material, including metals such as steel, aluminum, or titanium, and plastics where appropriate strength criteria are met that enable the snow fluke to function as both a climbing anchor and a shovel blade. As a non-limiting example, blade body 112 may be formed from a stamped sheet or plate of tempered aluminum.

Further, as depicted in FIG. 1, blade body 112 may include or define one or more openings that pass through the blade body as indicated schematically at 150. In some embodiments, these openings may be arranged symmetrically about central axis 160. These openings may be of any suitable size and shape that enables the snow fluke to maintain effective structural integrity while functioning as a climbing anchor and a snow shovel blade when combined with the snow picket. For example, blade body 112 may define a web-like support structure with openings 150. The various openings indicated schematically at 150 may include an assortment of different openings having various shapes, sizes, and orientations. In other embodiments, these openings may be of similar shape and size, or may be optionally omitted. Openings 150 in blade body 112 may serve to reduce the weight of the snow fluke and to provide a location where climbing equipment such as ropes, webbing, and carabiners may be attached.

Openings 150 may also serve as an attachment point for one or more rigging cables. For example, a rigging cable 180 is shown schematically in FIG. 1 having a first end 181 secured to snow fluke 110 via one or more of these openings. As a non-limiting example, a first end of rigging cable 180 may include a loop that passes through one or more openings 150 of blade body 112 as depicted in FIG. 1. It should be appreciated that rigging cable 180 may be coupled to blade body 112 in other suitable ways. For example, rigging cable 180 may pass through different openings or through a different number of openings in the blade body from that depicted in FIG. 1. Rigging cable 180 may be used to maintain snow fluke 110 in a mated configuration with snow picket 120 when functioning as a snow shovel, while rigging cable 180 may also be used to secure climbing gear such as ropes, webbing, and carabiners to the snow fluke when functioning as a climbing anchor.

Rigging cable 180 may comprise any suitable material. In some embodiments, rigging cable 180 may include a ⅛ inch diameter braided steel cable that is swaged at first end 181 to form the loop that passes through one or more openings of the blade body. In other embodiments, rigging cable 180 may comprise other suitable materials including flat or tubular nylon webbing, braided nylon rope, or cordage including a combination of nylon and metallic braided materials, among others. Rigging cable 180 may be configured to stretch in some embodiments; while in other embodiments rigging cable 180 may be configured to be substantially static (e.g. have little or no stretch). The amount of stretch afforded by rigging cable 180 may be selected so that a user may be able to apply sufficient tension in the rigging cable to maintain the snow fluke and snow picket in the mated configuration. In still other embodiments, rigging cable 180 may be optionally omitted, for example, where interface 130 includes a press-fit or other suitable coupling for retaining the snow fluke and the snow picket in the mated configuration depicted in FIG. 1.

Figure 2:
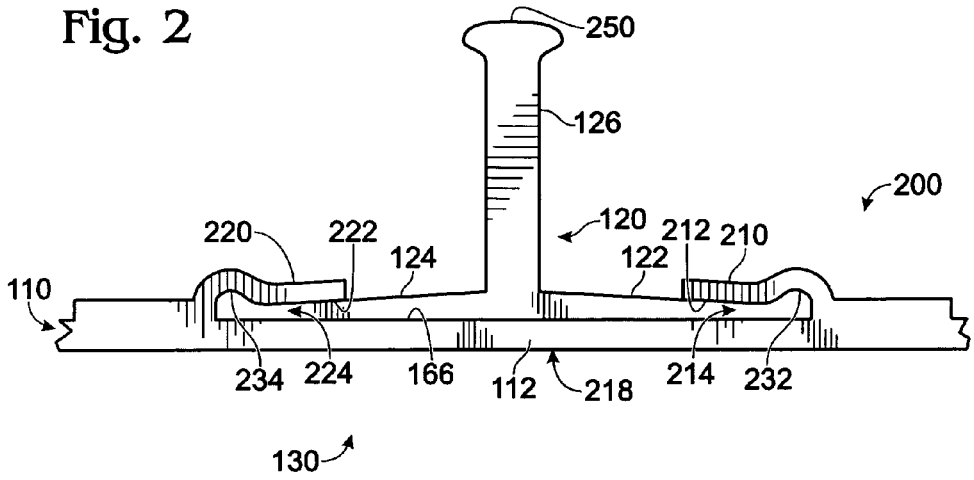
FIG. 2 shows a detailed cross-sectional view of an example interface between the snow fluke and the snow picket.

Snow picket 120 may comprise an elongate shaft which includes one or more flanges. For example, as shown in FIG. 1, snow picket 120 may have a T-shaped cross-section, which is defined by a first flange 122, a second flange 124, and a spine 126 joining the first and second flanges 122 and 124. FIG. 2 shows an orthogonal cross-section of snow picket 120, which depicts how flanges 122 and 124 may project outward from spine 126. In other embodiments, snow picket 120 may include other suitably shaped cross-sections. For example, the snow picket may instead include or define an elongate shaft having an L-shaped cross-section, an I-shaped cross-section, or an H-shaped cross-section, among others. As a non-limiting example, snow picket 120 may have a length of approximately 2-3 feet, and the flanges and spine may be approximately 1/16-⅛ of an inch thick. However, snow picket 120 may have other suitable sizes or shapes. Flanges 122 and 124, and spine 126 can serve as structural support against a bending moment of the snow picket while also serving to increase the holding force of the snow picket in snow or ice where it is used as a climbing anchor.

In some embodiments, spine 126 may include or define one or more openings that pass through the spine, as depicted at 128. Alternatively or additionally, flanges 122 and 126 may optionally include openings of the same or different size as openings 128, which pass through one or more of the flanges. One or more of these openings in the snow picket may be used to secure a second end of rigging cable 180 to the snow picket as indicated, for example, at 182. For example, rigging cable 180 may be woven through one or more openings in the snow picket or otherwise attached to the snow picket by a knot, a fastener such as a carabiner or a pin, a cleat, a notch, or other suitable approach.

FIG. 11 is a detailed view of rigging cable 180 attached to snow picket 120 via one of openings 128, as indicated at 182. In this particular example, opening 128, formed in spine 126, includes a groove or notch 1110 that is configured to accept rigging cable 180. A latching member 618 may be formed or mounted along rigging cable 180. This latching member can serve to increase the effective diameter of the rigging cable so that the rigging cable may be retained within groove 1110 by latching member 618. As a non-limiting example, latching member 618 may include a swage, a bead, a knot formed in the rigging cable, or other suitable structure that retains or latches the rigging cable to the snow picket.

Figure 6:
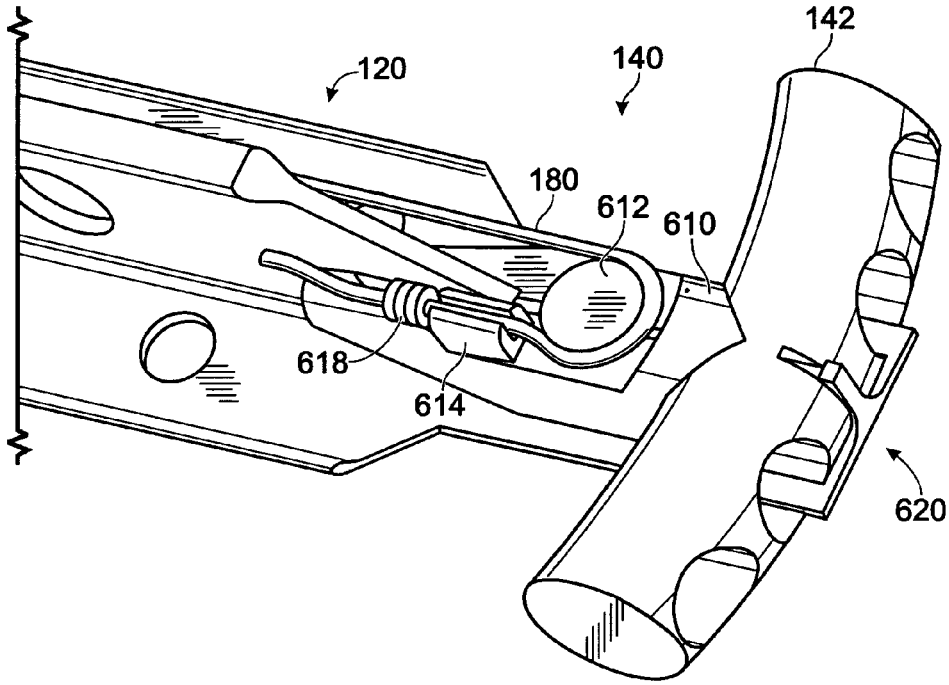
FIG. 6 shows detailed view of a first embodiment of an interface between a handle and the snow picket.
Figure 7:
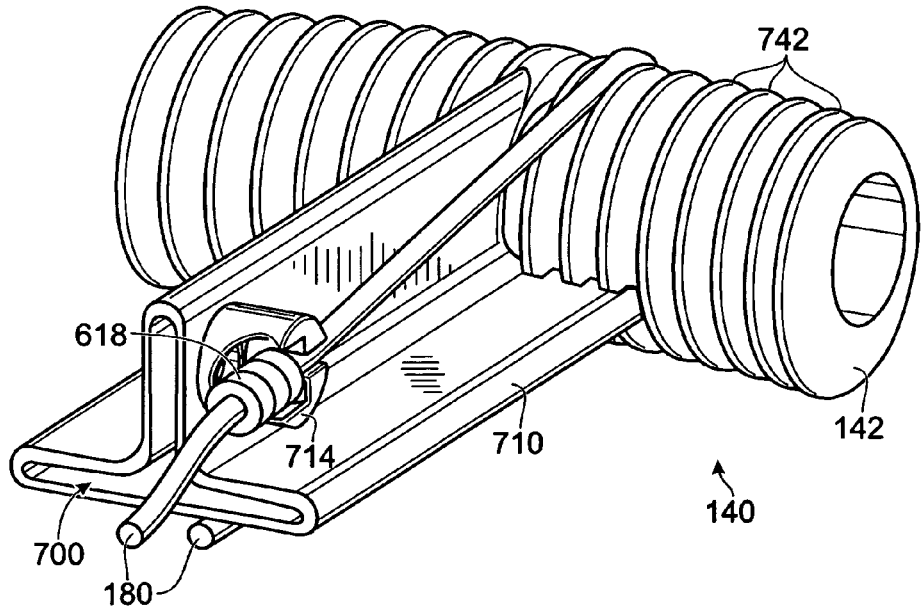
FIG. 7 shows detailed view of a second embodiment of an interface between a handle and the snow picket.

In still other embodiments, rigging cable may include a loop formed at each end for enabling attachment of the rigging cable to the multi-use snow tool. For example, a loop formed at the first end of the rigging cable may be used to secure the rigging cable to the snow fluke as depicted at 181, while a loop formed at the second end of the rigging cable may be wrapped around a peg, a pin, or other structure of the snow picket, or may be wrapped around the handle to retain the multi-use snow tool in the mated configuration of FIG. 1. FIGS. 6 and 7 depict other non-limiting examples of how the rigging cable may be secured to the multi-use snow tool.

By securing rigging cable 180 at first end 181 to snow fluke 110 and at second end 182 to snow picket 120 with sufficient tension, the snow picket and the snow fluke may be retained in the mated configuration depicted in FIG. 1. Openings 128 of spine 126 and/or other openings of flanges 122 and 124 may also be used to secure climbing gear such as ropes, webbing, and carabiners to the snow picket when functioning as a climbing anchor. Further still, these openings can also serve to reduce the weight of the snow picket.

Snow picket 120 may comprise any suitable material, including metals such as steel, aluminum, or titanium, and plastics or carbon fiber where appropriate strength criteria are met which enable the snow picket to function as a climbing anchor. As a non-limiting example, snow picket 120 may be formed by an extrusion of tempered aluminum, where openings 128 may be stamped or punched in the flanges and/or spine of the snow picket. However, in other embodiments, snow picket 120 may be formed by forging or other suitable manufacturing approach. As will be described in greater detail with reference to FIGS. 9 and 10, the snow picket may include a serrated edge or surface that resists removal of the snow picket from snow or ice, thereby improving the anchoring function of the snow picket.

A nose end 121 of snow picket 120 may be detachably coupled to and mated with snow fluke 110 via interface 130. Interface 130 may include any suitable interface that permits snow picket 120 to be secured to snow fluke 110 (e.g. where snow shovel functionality is desired), while also permitting snow picket 120 to be released from snow fluke 110 (e.g. where the snow picket and snow fluke may be used independent of each other as climbing anchors). Example embodiments of interface 130 are described in greater detail with reference to FIGS. 2-5.

Figure 3:
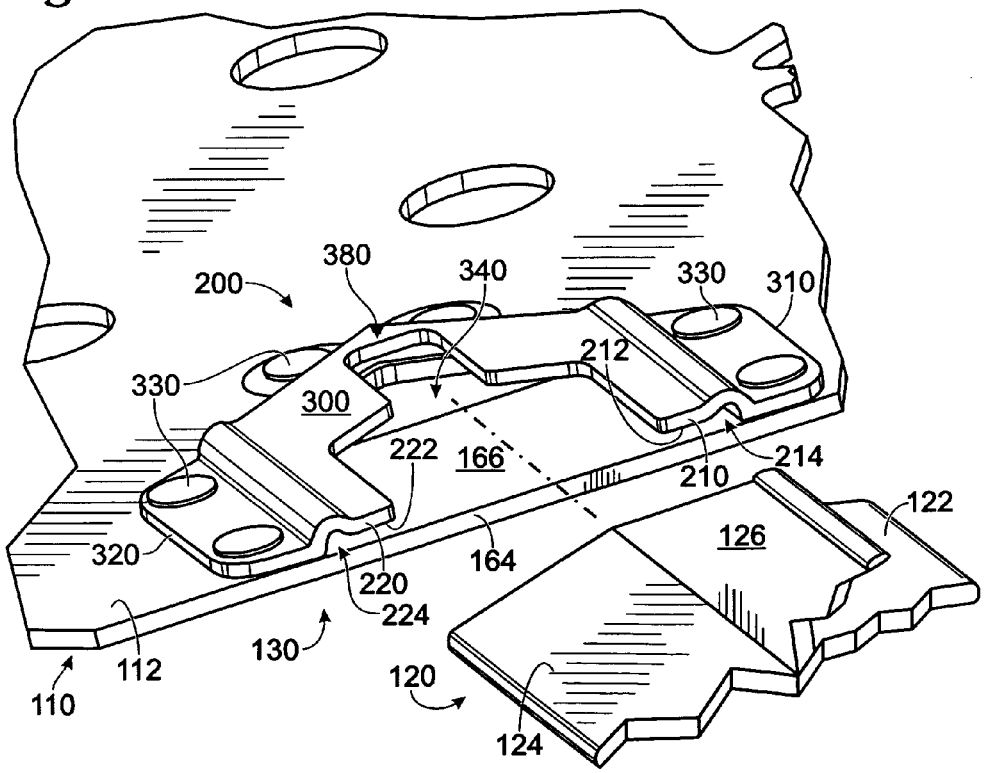
FIG. 3 shows a detailed view of a first example embodiment of a lip assembly for the interface of FIG. 2.

In some embodiments, snow picket 120 may taper inward at nose end 121 as shown in FIG. 1 and FIG. 3. For example, one or more of flanges 122 and 124, and spine 126 may be tapered at nose end 121 to improve penetration of snow picket 120 into snow or ice when functioning as a climbing anchor, and to facilitate the mating of snow picket 120 with snow fluke 110 at interface 130. In other embodiments, one or more of flanges 122 and 124, and spine 126 may not be tapered at nose end 121.

In some embodiments, a tail end 123 of snow picket 120 may be detachably coupled to and mated with a handle 140. Handle 140 may include a handle bar 142 and may be further adapted to receive tail end 123 of snow picket 120. Handle 140 may comprise any suitable material, including metals such as steel, aluminum, or titanium, and plastics. For example, handle 140 may be formed from an injection molding of plastic or alternatively from forged aluminum. In some embodiments, handle 140 may comprise a plurality of different materials. For example, handle 140 may include a core formed from a metal material and a shell formed from a plastic or rubber material. In other embodiments, handle 140 may be optionally omitted from multi-use snow tool 100. Interface 170 between handle 140 and snow picket 120 is described in greater detail with reference to FIGS. 6 and 7.

In some embodiments, handle 140 and snow picket 120 may be retained in the mated configuration depicted in FIG. 1 by rigging cable 180. As one example, a second end of rigging cable 180 may be secured to handle 140 as indicated at 184, rather than being secured directly to snow picket 120 as indicated at 182. In this way, a single rigging cable may be used to maintain the snow fluke, the snow picket, and the handle in the mated configuration, thereby further enabling a reduction in the number of parts and/or weight of multi-use snow tool 100. It should be appreciated that in some embodiments, a second rigging cable may be used to retain handle 140 and snow picket 120 in the mated configuration. Further, in other embodiments, handle 140 may be detachably coupled to snow picket 120 by a clip, press-fit, pin, or other suitable coupling. Further still, in other embodiments, handle 140 may be permanently coupled with snow picket 120.

In still other embodiments, rigging cable 180 may be of a sufficient length to permit the rigging cable to be wrapped around an end of handle 140 as indicated at 186, whereby the second end of the rigging cable may be secured to the handle as indicated at 184 or instead secured to the snow picket as indicated at 182. As a non-limiting example, rigging cable 180 may have a length of approximately 20-50 inches. As depicted in FIG. 7, handle bar 142 may include a groove or channel in the end of handle 140 for guiding the rigging cable around the handle bar. Thus, in each of these examples, the rigging cable can be used to maintain two or more of the snow fluke, the snow picket, and the handle in the mated configuration, while also permitting the snow picket, snow fluke, and handle to be selectively detached from each other upon release of the rigging cable.

Figure 8:
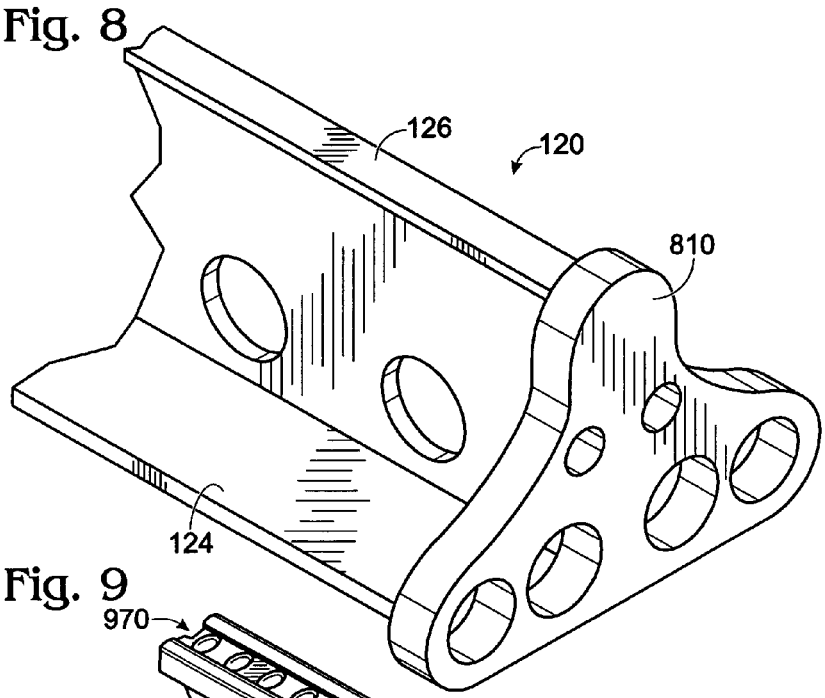
FIG. 8 shows an alternative embodiment of the snow picket including a handle that is defined by a substantially blunt end cap.

As also depicted by FIG. 1, snow picket 120 may taper inward at tail end 123 in at least some embodiments. For example, one or more of flanges 122 and 124, and spine 126 may be tapered inward at tail end 123 to facilitate the mating of snow picket 120 with handle 140 at interface 170. In other embodiments, one or more of the flanges 122 and 124, and spine 126 may not be tapered at tail end 123. For example, as shown in FIG. 8, tail end 123 of snow picket 120 may include a substantially blunt end cap, which may function as a head upon which snow picket 120 may be driven into snow or ice by a hammer, a user's foot, a user's hand, or other suitable implement.

It should be appreciated that in other embodiments, the snow fluke may be instead adapted to receive the tail end of the snow picket, while the handle may be instead adapted to receive the nose end of the snow picket. For example, if a flange or spine of the nose end of the snow picket becomes bent or misshaped from being driven against a hard surface, the snow fluke and the snow picket may still be combined with the snow fluke in order to function as a snow shovel.

FIG. 2 shows a detailed cross-sectional view of an example embodiment of interface 130 between snow picket 120 and snow fluke 110. In this example embodiment, snow picket 120 is depicted as having a T-shaped cross-section, including first flange 122, second flange 124, and spine 126. However, the snow picket may have other suitably shaped cross-sections, while also permitting the snow picket and snow fluke to be detachably coupled with each other.

For example, FIG. 2 further depicts an example where interface 130 may utilize a lip assembly 200 that is configured to receive one or more flanges of snow picket 120. As a non-limiting example, lip assembly 200 may be located at or near base end 164 of blade body 112 as depicted in FIG. 3.

However, in other embodiments, lip assembly 200 may be located at any suitable location with regards to blade body 112.

As one example, lip assembly 200 may include at least a first lip portion 210. First lip portion 210 may include an inwardly facing surface 212, which may collectively define a first channel 214 with outwardly facing surface 166 of blade body 112. First channel 214 may be adapted to receive a first flange of the snow picket, such as flange 122 of T-shaped snow picket 120.

Lip assembly 200 may also include a second lip portion 220. An inwardly facing surface 222 of second lip portion 220 and the outwardly facing surface 166 of blade body 112 may collectively define a second channel 224 that is spaced apart from and opposes the first channel. Second channel 224 may be adapted to receive a second flange of the snow picket, such as flange 124 of T-shaped snow picket 120. In some embodiments, the first lip portion and the second lip portion may be arranged symmetrically about central axis 160 of the blade body so that spine 126 resides along central axis 160 when arranged in the mated configuration.

Figure 5:
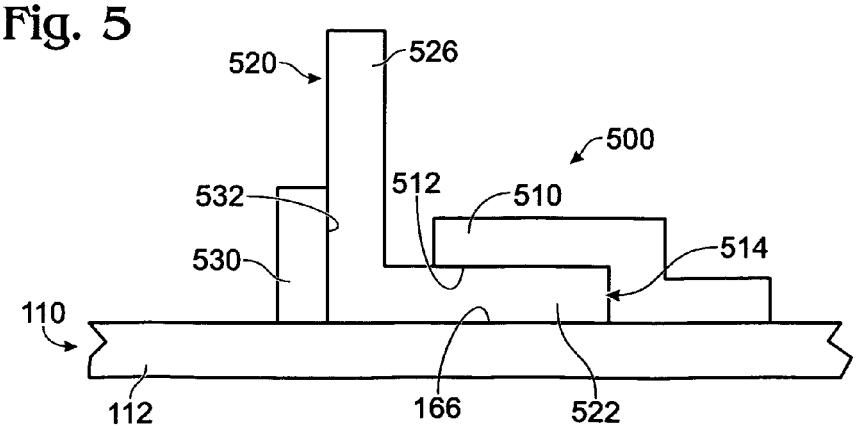
FIG. 5 shows a detailed cross-sectional view of another example interface between the snow fluke and the snow picket.

In other embodiments, second lip portion 220 may be optionally omitted. For example, as depicted in FIG. 5, a lip assembly may be adapted to receive a snow picket having an L-shaped cross-section which includes only a single flange and spine. In this way, the multi-use snow tool can include at least one lip portion that cooperates with an outwardly facing surface of the blade body to define at least one channel that is adapted to receive a corresponding flange of the snow picket.

As shown in FIG. 2, first channel 214 and second channel 224 may be adapted to receive the snow picket in a configuration that orientates an outer edge 250 of spine 126 in substantially the same direction as outwardly facing surface 166 of blade body 112. In other embodiments, first channel 214 and second channel 224 may be adapted to receive the snow picket in a configuration that instead orientates outer edge 250 of spine 126 in an opposite direction from the orientation depicted in FIG. 2 so that outer edge 250 faces in substantially the same direction as a second outwardly facing surface 218 of blade body 112. It should be appreciated that the snow picket may be orientated in other directions relative to the snow fluke when they are mated with each other.

Figure 9:
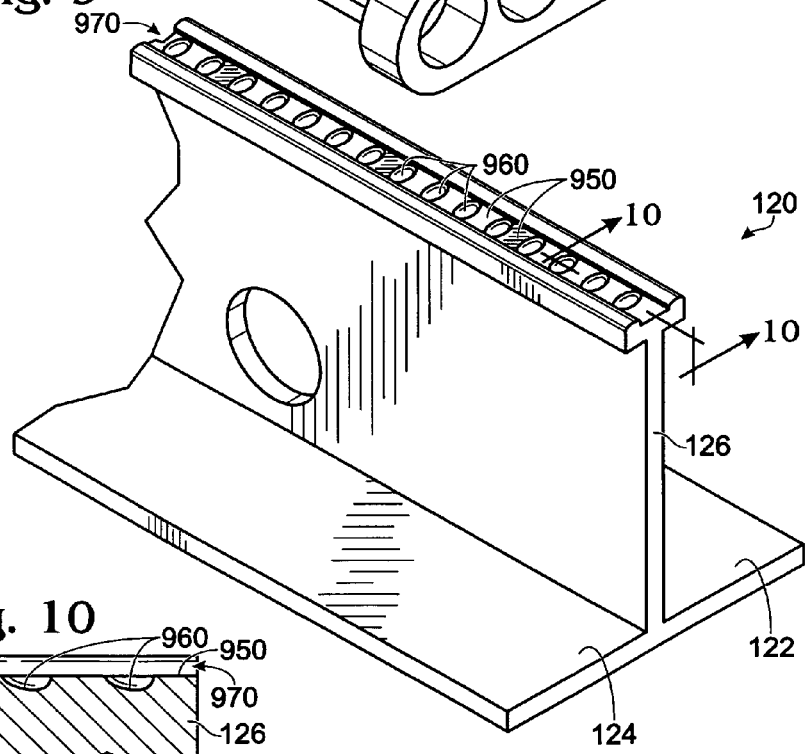
FIGS. 9 and 10 show an example embodiment of a unidirectional serrated surface that may be included with the snow picket.

As further shown in FIG. 2, each of channels 214 and 224 may have a shape that corresponds to a shape of a respective snow picket flange. For example, as indicated at 232, first channel 214 may define a shape that corresponds to a radiused end of flange 122. Similarly, as indicated at 234, second channel 224 may define a shape that corresponds to a radiused end of flange 124. As a non-limiting example, the ends of flanges 122 and 124 may have a radius of approximately 1/64-1/4 inches. In other embodiments, the radiused ends of flanges 122 and 124 may be omitted, whereby channels 214 and 224 may instead have a rectilinear shape that corresponds to rectilinear ends of the flanges. For example, FIGS. 8 and 9 depict flanges 122 and 124 as having rectilinear cross-sections. Further still, it should be appreciated that channels 214 and 224 may have any suitable shape that corresponds to the flanges of the snow picket.

In some embodiments, channels 214 and 224 may be sized relative to their corresponding snow picket flanges so that the flanges are frictionally retained in their respective channels by a press-fit, at least to the extent that snow picket may still be physically removed or detached from the snow fluke by a user when independent use of the snow picket and snow fluke is desired. As a non-limiting example, lip portions 210 and 220 may be configured to flex and/or deform in some embodiments in order to maintain a press-fit between the flanges and the channels. In other embodiments, channels 214 and 224 may be sized relatively larger to more easily accommodate the flanges of the snow picket without utilizing a press-fit, particularly where a rigging cable or other suitable coupling may be relied upon to retain the snow fluke and the snow picket in the mated configuration.

Figure 4:
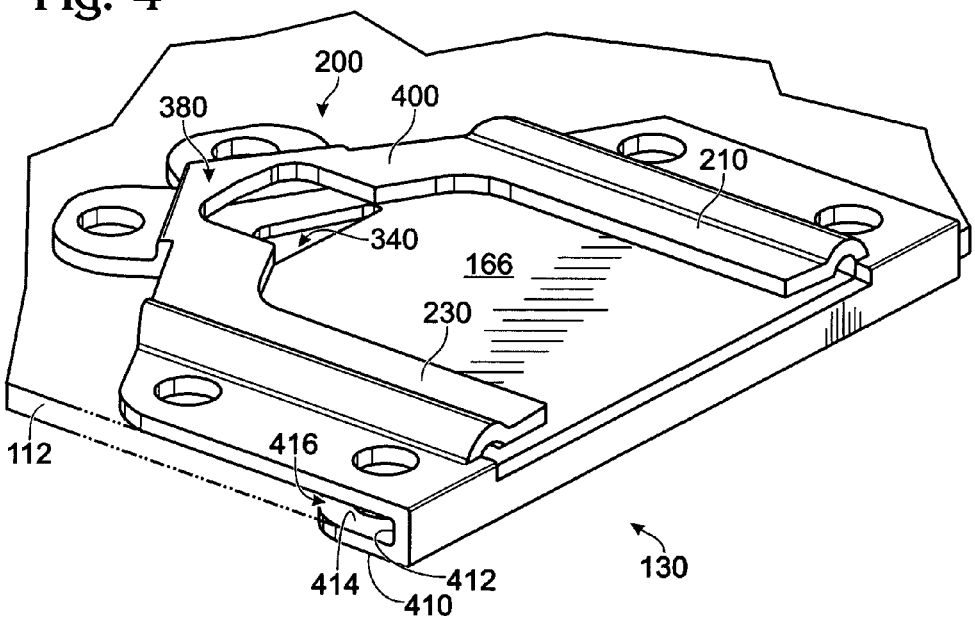
FIG. 4 shows a detailed view of a second example embodiment of a lip assembly for the interface of FIG. 2.

FIG. 2 further demonstrates how lip assembly 200, including lip portions 210 and 220 may be integrally formed with blade body 112 in some embodiments. In other words, lip portions 210 and 220, and blade body 112 may be formed from a single piece of material. Alternatively, lip portions 210 and 220, and blade body 112 may be permanently coupled to the blade body by welds, adhesives, or fasteners. FIGS. 3 and 4 depict examples where the lip assembly may be instead defined by a distinct mounting bracket. Although, it should be appreciated that the features described with reference to FIGS. 3 and 4 may also be integrally formed with the blade body of the snow fluke.

FIG. 3 shows a detailed view of an example embodiment of lip assembly 200. In this particular embodiment, lip assembly 200 is defined by a mounting bracket 300 which includes lip portions 210 and 220. Therefore, as shown in FIG. 3, first lip portion 210 and second lip portion 220 may collectively constitute a common mounting bracket. In other embodiments, lip portions 210 and 220 may include separate mounting brackets.

Mounting bracket 300 may be mounted to outer facing surface 166 via one or more mounting portions. For example, mounting bracket 300 may include a first mounting portion 310 and a second mounting portion 320 that provide mounting surfaces that interface with outwardly facing surface 166 of blade body 112. Mounting portions 310 and 320 may be coupled to blade body 112 by any suitable approach, including the use of fasteners such as bolts, screws, rivets, pins, etc., adhesives, and welds. For example, as shown in FIG. 3, mounting bracket 300 may be coupled to blade body 112 via a plurality of fasteners indicated schematically at 330. Note that these fasteners may pass completely through both the blade body and mounting bracket in some embodiments via corresponding openings in each that are sized to accept the fasteners. As a non-limiting example, fasters 330 may comprise rivets.

In some embodiments, channels 210 and 220 may be substantially parallel to each other (at least at the entrance of the channels) so as to accommodate the two substantially parallel flanges of the snow picket. In some embodiments, the mounting bracket may taper inward to form a pocket as indicated at 380 for receiving a tapered nose end of the snow picket. Pocket 380 may serve as a backstop which resists further translation of snow picket 120 relative to snow fluke 110. As a non-limiting example, pocket 380 may be arranged relative to channels 210 and 220 to permit approximately 1/8 inch-3 inches or more of the nose end of snow picket 120 to be received by lip assembly 200.

As a non-limiting example, the channels may have a length of approximately 2 inches. In other examples, the channels may optionally terminate before reaching pocket 380, whereby the ends of the channels may be spaced apart from the pocket. These channels may be located at or near base end 164 of the blade body and may have a relative shorter length than depicted in FIG. 3. For example, the channels may have a length that is as short as 1/8 inch, whereby the ends of the channels that face away from base end 164 may be spaced apart from pocket 380 by 1-3 inches. Further still, channels 210 and 220 may taper inward in some embodiments to accommodate tapered flanges at the nose end of the snow picket. In other embodiments, pocket 380 may be omitted and channels 210 and 220 may be arranged substantially parallel to each other along their entire length, thereby enabling snow picket 120 to be translated within channels 210 and 220 relative to the snow fluke along the entire length of the snow picket.

In some embodiments, blade body 112 may further include or define one or more additional openings, such as opening 340, that passes through the blade body at a location that is substantially between the first and second channels. Opening 340 can be shaped and sized to facilitate the expulsion of snow, ice, or other contaminants from the channels or from the region between the channels as the flanges are inserted into the channels. For example, as a user inserts the flanges of the snow picket into the channels, snow or ice may be expelled out the opposite side of the blade body via opening 340. In this way, build-up of snow or ice within the channels or the region between the channels may be reduced, thereby reducing obstructions that may inhibit or restrict the snow fluke from receiving and mating with the snow picket.

FIG. 4 shows a detailed view of a second embodiment of lip assembly 200. The second embodiment of lip assembly 200 may be similar in many respects to the first embodiment depicted in FIG. 3. However, lip assembly 200 may be instead defined by a mounting bracket 400 in the second embodiment which includes a third lip portion 410. Third lip portion 410 may provide additional mounting surfaces by which the mounting bracket can interface with the blade body in addition to those provided by mounting portions 310 and 320. Additionally, lip portion 410 can create a protective surface at the base end of the snow fluke, which can reduce bending or deformation of blade body 112 as snow fluke 110 is inserted into ice or snow.

For example, as shown in FIG. 4, third lip portion 410 may be configured to extend around base end 164 of blade body 112 so that a mounting surface 412 interfaces with the outer edge of the blade body. Third lip portion 410 may further include a third mounting surface 414 that interfaces with second outwardly facing surface 218 of blade body 112. In this way, the base end of the blade body may be sandwiched between at least two opposing mounting surfaces of the mounting bracket, thereby further strengthening the interface between the snow fluke and the snow picket. As described with reference to FIG. 3, any suitable approach may be used to couple mounting bracket 400 to blade body 112, including fasteners, welds, or adhesives. As shown in FIG. 4, one or more openings may be provided in mounting bracket 400 for accepting fasteners that pass through lip portion 410, blade body 112, and the mounting portions of the mounting bracket. In this way, a single fastener may secure the blade body to both the third lip portion and one of the mounting portions of the mounting bracket.

Mounting brackets 300 and 400 may comprise any suitable materials, including metals such as steel, aluminum, or titanium, and plastics where appropriate strength criteria are met that enable the mounting bracket to retain the snow picket in the mated configuration with the snow fluke. As a non-limiting example, brackets 300 and 400 may be formed from a sheet or plate of steel, aluminum, or titanium having a thickness of approximately 0.075 inches. However, it should be appreciated that other suitable bracket dimensions may be used.

While blade body 112 has been depicted in FIGS. 3 and 4 as including a substantially planar outwardly facing surface 166, in other embodiments, channels 214 and/or 224 may be at least partially defined by depressions or surface contour that are formed in the blade body. As shown in FIG. 2, channels 214 and 224 may be collectively defined by outwardly facing surface 166 and lip portions 210 and 220. Thus, outwardly facing surface 166 of blade body 112 may include any suitably shaped depression or surface contour that accommodates the snow picket flanges.

FIG. 5 further depicts an example of interface 130 that may be instead include a lip assembly 500 that is adapted to receive a flange or spine of a snow picket 520 which includes an L-shaped cross-section. For example, lip assembly 500 may include a lip portion 510 which includes an inwardly facing surface 512 that collectively defines a channel 514 with outwardly facing surface 166. Lip assembly 500 may further include a backstop 530 against which a spine 526 of snow picket 520 may be supported. Channel 514 may be adapted to receive a flange 522 of the L-shaped snow picket. FIG. 5 demonstrates that one or more flanges of the snow picket may include a rectilinear shape in contrast to the radiused flanges depicted in FIG. 2. It should be appreciated that lip portion 510 and backstop 530 may be integrally formed with blade body 112 in some embodiments, or may alternatively comprise one or more distinct mounting brackets in other embodiments.

An advantage of the various embodiments described with reference to interface 130, and as demonstrated by FIGS. 1-5, includes the relatively thin profile of the snow fluke that may be achieved while at the same time enabling a snow picket having a substantially broader spine and flanges to be combined with the snow fluke to provide additional functionality. For example, lip portions 210 and 220 can reside relatively close to the surface of the blade body, thereby reducing the size of the snow fluke at the interface with the snow picket.

FIGS. 6 and 7 show detailed views of different embodiments of interface 170 between handle 140 and snow picket 120. For example, as depicted in FIG. 6, handle 140 includes a handle body 610 and a handle bar 142. Handle body 610 may include or define one or more channels as depicted, for example, at 620 that are adapted to receive a corresponding flange or spine of the snow picket.

In some embodiments, handle body 610 may include a tensioning portion 612 that may assist the user apply sufficient tension to rigging cable 180. Tensioning portion 612 may comprise a ridge, lip, or other suitable structure around which rigging cable 180 may be wrapped before the second end of the rigging cable is secured to handle 140 or snow picket 120. In some embodiments, handle body 610 may include a latching portion 614 which can latch onto and retain the second end of the rigging cable.

As a non-limiting example, the user may pull the second end of the rigging cable toward handle 140 along the length of the snow picket and away from the first end of the rigging cable, whereby the second end of the rigging cable may be passed over tensioning portion 612 to apply sufficient tension to rigging cable 180 for retaining the snow picket, snow fluke, and handle in the mated configuration while the second end may be latched to the handle by latching portion 614. In some embodiments, latching portion 614 may include or define a groove that is sized to receive the rigging cable. Further, in some embodiments, rigging cable 180 may include a latching member 618 that cooperates with latching portion 614 to latch the second end of rigging cable 180 in a tensioned state as set by the user. For example, latching member 618 may comprise a swage or other suitable structure configured to retain rigging cable 180 within a groove or channel formed in latching portion 614. In this way, the snow fluke, snow picket, and handle may be retained in the mated configuration as depicted by FIG. 1.

Still other suitable approaches may be used to secure the second end of the rigging cable. For example, in other embodiments, tensioning portion 612 may be optionally omitted, where the second end of the rigging cable may be secured to latching portion 614 without first passing around tensioning portion 612. In other embodiments, latching portion 612 may be instead located on snow picket 120 instead of handle body 612, where tensioning portion 612 may be optionally included to assist the user apply sufficient tension to the rigging cable. In still other embodiments, handle bar 142 may be optionally used to carry out a similar function as tensioning portion 612.

For example, referring also to FIG. 7, rigging cable 180 may be passed over handle bar 142 as depicted at 186 in FIG. 1, before being secured to a latching portion 714. In some embodiments, handle bar 142 may include one or more ridges 742 which define grooves which may guide and retain the rigging cable as it is passed over the end of the handle bar. Latching portion 714 is depicting in FIG. 7 as including a groove that is sized to receive rigging cable 180, while retaining latching member 618.

FIG. 7 further depicts how handle 140 may include a handle body 710 that includes or defines an opening 700 that is adapted to receive the snow picket. For example, opening 700 may define a T-shaped opening for receiving a T-shaped snow picket, such as snow picket 120. It should be appreciated that handle body 710 may define other openings that are adapted to receive snow pickets having other suitable shapes, including L-shaped, I-shaped, and H-shaped cross-sections.

In other embodiments, handle bar 142 may be configured as a D-shaped handle bar, rather than the T-shaped handle bar depicted in FIGS. 1, 6 and 7. Further, in some embodiments, handle 140 may be permanently affixed to the snow picket via casting, forging, welds, adhesives, or fasteners. Handle 140 may be configured to be used as a head upon which snow picket 120 may be driven into ice or snow by a hammer, a hand of the user, a foot of the user, or other suitable implement.

FIG. 8 shows a detailed view of an alternative embodiment where base end 123 of snow picket 120 includes an end cap 810 that substantially covers the T-shaped cross-section (or other suitable cross-sectional shape) of the snow picket. In some examples, end cap 810 may form a substantially blunt surface by which the snow picket may be driven into snow or ice. Further, end cap 810 may provide a handle against which a user may place the palm of their hand while performing a digging operation with the multi-use snow tool.

As shown in FIG. 8, end cap 810 may include or define one or more openings that pass through the end cap. These openings may be used to reduce the weight of the snow picket and may serve as an additional point of attachment for rigging cable 180. End cap 810 may be integrally formed with snow picket 120 in some embodiments, while in other embodiments end cap 810 may be coupled to the snow picket by adhesives, welds, press-fits, or fasteners. End cap 810 may comprise any suitable material, including titanium, steel, aluminum, plastic, or rubber, for example. In the embodiment depicted in FIG. 8, multi-use snow tool 100 does not include handle 140. Note that while flanges 122 and 124 are depicted in FIGS. 8 and 9 as having rectilinear cross-sections, it should be appreciated that these flanges may alternatively include radiused ends as depicted at 232 and 234 in FIG. 2, for example.

In some embodiments, the snow fluke and/or snow picket may include surface structure that increases sliding resistance in one or more directions. This surface structure may be used to increase the holding strength of the snow picket or snow fluke in ice or snow. As a non-limiting example, this surface structure may include a uni-directional serration.

Figure 10:
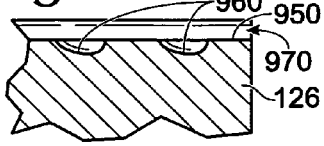

For example, FIGS. 9 and 10 show a detailed view of spine 126 of snow picket 120 including surface structure that resists removal of the snow picket from ice or snow. In this embodiment, an outer edge 250 of spine 126 includes a serrated surface 950 that extends along a length portion of the snow picket. As depicted by FIGS. 9 and 10, serrated surface 950 may be provided within a channel 970; however, serrated surface 950 may be applied directly to any surface of the snow picket or snow fluke without the inclusion of a channel. Thus, channel 970 may be optionally omitted in other embodiments. Serrated surface 950 may be configured as a unidirectional serrated surface, which resists translation of the snow picket relative to surrounding ice and snow to a greater extend in a particular direction. As one example, the surface structure may provide greater resistance to removal of the snow picket from ice or snow than is provided by the surface structure during insertion of the snow picket into the ice or snow.

Serrated surface 950 may include any suitable surface structure that increases the sliding resistance along the surface of the snow picket or snow fluke in at least one direction. As a non-limiting example, serrated surface 950 includes a plurality of depressions 960 which each form a serration along at least one edge of the depression. As shown in FIG. 10, depressions 960 may be asymmetric about an orthogonal cross-section of the snow picket so that a leading edge of the depression provides a substantially greater serration than the tail edge of the depression. The leading edge may be located on the edge of the depression that is closest to the nose of the snow picket or the nose of the snow fluke, thereby providing increased resistance to removal from ice or snow. As a non-limiting example, depressions 960 may have a width of approximately ¼ inch and a length of approximately 1/16-1 inch, and may have a depth which corresponds to a serration height at the leading edge of the depression of approximately 1/64 inch-¼ inch. However, other suitable dimensions may be used.

In some embodiments, depressions 960 may be circular or semi-circular. However, other suitable surface structure may be provided by adding or removing material from the surface of the snow picket or snow fluke, including stamping, forging, casting, welding, mechanical attachments, or by removal of material by laser or machining. In some embodiments, a serrated surface, such as serrated surface 950, may be provided on other surfaces of snow picket 120 or snow fluke 110. For example, a serrated surface may be provided on an outer edge or face of flanges 122 and 124. In other embodiments, serrated surface 950 may be optionally omitted. It should be appreciated that serrated surfaces such as serrated surface 950 may be provided on snow fluke 110 in some embodiments, including on outwardly facing surfaces 166 and 218, and along edge 168. In this way, snow picket 120 and snow fluke 110 may optionally include one or more surfaces that resist removal of the tool from ice or snow, thereby improving the anchoring function of the tool.

FIGS. 12-15 show a non-limiting example of a pin assembly 1200 for maintaining the snow fluke and snow picket in the mated configuration shown schematically in FIG. 1. In this example, pin assembly 1200 is described in the context of an embodiment of the multi-use snow tool which does not include a lip assembly and corresponding bracket as previously described with reference to FIGS. 2-5. However, it should be appreciated that pin assembly 1200 or other suitable pins or pin assemblies may optionally be used in conjunction with the various lip assemblies and corresponding brackets described herein to retain the multi-use snow tool in the mated configuration.

Figure 12:
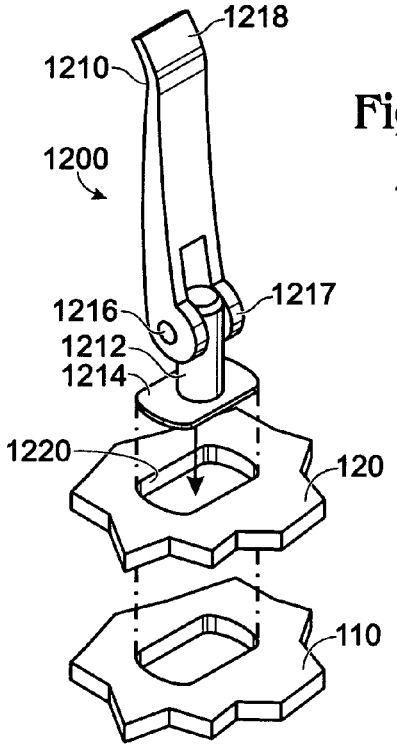
FIGS. 12-15 show an example pin assembly for maintaining the snow fluke and snow picket in the mated configuration of FIG. 1.
Figure 15:
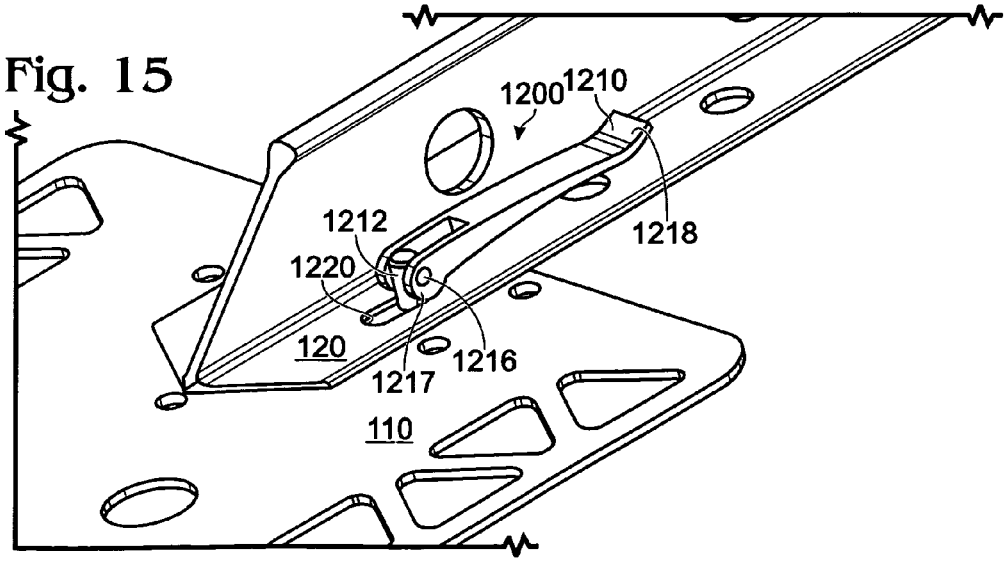

Referring specifically to FIG. 12, pin assembly 1200 may include an engagement arm 1210 that is rotationally coupled to shaft 1212 via a hinge 1216. Engagement arm 1210 may include a cam lobe 1217 which may be used to generate a clamping force between the snow picket and snow fluke as shown in FIG. 15. Cam lobe 1217 may have a non-uniform lift profile relative to hinge 1216 such that rotation of the cam lobe creates a different cam lift height relative to hinge 1216. For example, cam lobe 1217 may have a non-circular cam profile and/or hinge 1216 that may be placed off-center relative to the centroid of cam lobe 1217 to provide a different cam lift height at different angles of rotation of the engagement arm relative to shaft 1212.

Shaft 1212 may include a retention member 1214 disposed at an opposite end of shaft 1212 from hinge 1216. Retention member 1214 may have a size and shape that enables it to be inserted through opening 1220 when properly aligned with the opening as depicted in FIG. 1. For example, retention member 1214 may have a shape that has a greater length in a first coordinate direction than a second coordinate direction. Shaft 1212 may be of a length that generally corresponds to the thickness of the portions of snow fluke 120 and snow picket 110 through which opening 1220 is formed. For example, FIG. 13 shows a non-limiting example of the relative arrangement of pin assembly 1200 after retention member 1214 of shaft 1212 has been passed through opening 1220.

Figure 13:
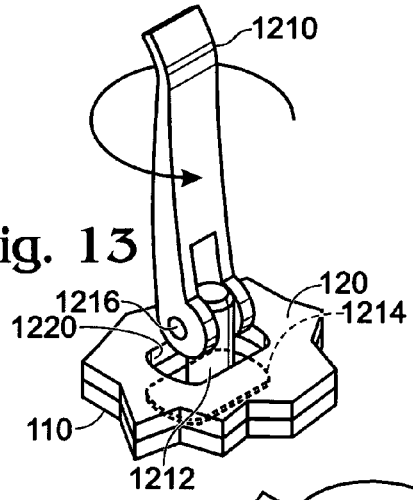
Figure 14:
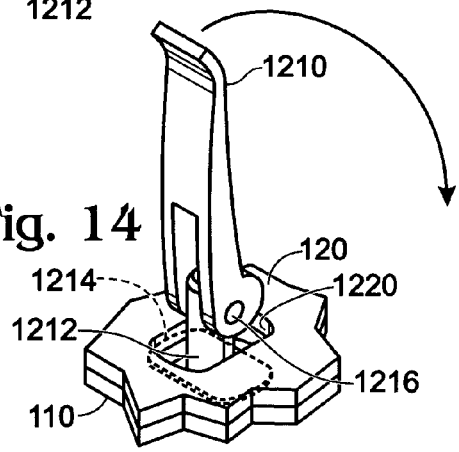

After shaft 1212, including retention member 1214, has been inserted through opening 1220, pin assembly 1200 may be rotated from the position shown in FIG. 13 to the position shown in FIG. 14. Rotation of the pin assembly can be used to rotate retention member 1214 out of alignment with opening 1220, thereby retaining shaft 1212 within opening 1220.

After retention member 1214 has been rotated out of alignment with opening 1220 as shown in FIG. 14, a distal end of engagement arm 1210 may be rotated downward toward snow fluke 120 and snow picket 110, thereby locking the snow fluke and snow picket in the mated configuration depicted in FIG. 15. As one example, rotation of engagement arm 1210 may cause the lift height of cam lobe 1217 that is in contact with snow picket 120 to be increased, which in turn causes engagement member 1214 to be drawn against the opposite side of snow fluke 110, thereby clamping snow fluke 110 and snow picket 120 together as shown in FIG. 15. For example, the cam lobe may be arranged relative to the hinge such that a distance between the cam lobe and the retention member is reduced as a distal end of the engagement arm is rotated toward the flange, thereby locking the snow picket to the snow fluke. Conversely, the distance between the cam lobe and the retention member may be increased as the distal end of the engagement arm is rotated away from the flange. Cam lobe 1217 may be shaped to provide sufficient holding force between snow picket 120 and snow fluke 110 to maintain the multi-use snow tool in the mated configuration that enables the tool to be used to conduct a digging operation.

In some embodiments, engagement arm 1210 may optionally include a tab 1218 located at the distal end. Tab 1218 may be curved or bent away from the snow picket when pin assembly 1200 is in the locked position shown in FIG. 15. Tab 1218 can enable a user to more easily grasp the distal end of the engagement arm when unlocking the pin assembly. Pin assembly 1200 may be unlocked by rotating the distal end of the engagement arm away from the snow picket, and by reversing the process depicted in FIGS. 12-15. Tab 1218 can be configured to enable a user to unlock the pin assembly even when the user is wearing gloves. In some embodiments, tab 1218 can provide sufficient structure to enable a user to unlock the pin assembly with a boot or shoe. In other embodiments, tab 1218 may be omitted, thereby enabling engagement arm 1210 to provide a more streamlined interface between the snow picket and the snow fluke.

As shown in FIG. 15, opening 1220 may be formed in a flange of the snow picket. In some embodiments, the snow picket may be coupled to the snow fluke by two or more pin assemblies. For example, a first pin assembly may be utilized with an opening formed in a first flange of the snow picket and a second pin assembly may be utilized with an opening formed in a second flange of the snow picket located on the opposite side of the spine. Further still, it should be appreciated that pin assembly 1200 may be inserted through the opposite side of opening 1220 from the configuration depicted in FIGS. 12-15 in order to lock the snow fluke to the snow picket.

As a non-limiting example, the multi-use snow tool comprises: a snow fluke including a blade body defining a first opening; a snow picket including at least a first flange, the first flange defining a second opening; and a pin assembly, including: an elongate shaft; a retention member arranged at a first end of the shaft, the retention member configured to pass through both the first opening and the second opening when the retention member is rotated to a first orientation relative to the first and second openings, and where the retention member is configured to resist removal from the first and second openings when the retention member is rotated to a second orientation relative to the first and second openings; and an engagement arm rotationally coupled to a second end of the shaft by a hinge, the engagement arm including a cam lobe, the cam lobe arranged relative to the hinge such that a distance between the cam lobe and the retention member is reduced as a distal end of the engagement arm is rotated toward the flange, thereby locking the snow picket to the snow fluke.

In still other embodiments, the snow fluke and snow picket may be permanently joined or coupled to each other in a manner that does not permit the snow fluke and snow picket to be uncoupled from each other for independent use. For example, snow fluke 110 and snow picket 120 may be integrally formed, or snow fluke 110 may be coupled to snow picket 120 by one or more fasteners, welds, press-fits and adhesives. Where snow fluke 110 and snow picket 120 are permanently joined to each other, they may be used as a snow shovel to provide a digging function, or they may be used in combination as a climbing anchor that combines the functionality of both a snow fluke and a snow picket. For example, the combined snow fluke and snow picket may be driven into ice or snow, or buried in ice or snow to provide an anchoring function even when they are not physically separable from each other.

Similarly, in some embodiments, handle 140 and snow picket 120 may be permanently joined or coupled to each other in a manner that does not permit handle 140 and snow picket 120 to be separated from each other for independent use. For example, handle 140 and snow picket 120 may be integrally formed, or handle 140 may be coupled to snow picket 120 by one or more fasteners, welds, press-fits, and adhesives. Further, where snow picket 120 and handle 140 are permanently joined to each other, the handled snow picket may be used with or without snow fluke 110.

In still other embodiments, snow picket 120 may be permanently joined to snow fluke 110 at a first end and may be permanently joined to handle 140 at a second end. Therefore, it should be appreciated that the specific examples described herein and presented by way of illustration should not be limited to snow pickets that may be separated from the snow fluke or the handle, but may include the snow fluke and/or handle as permanently joined components of the multi-use snow tool.

Figure 16:
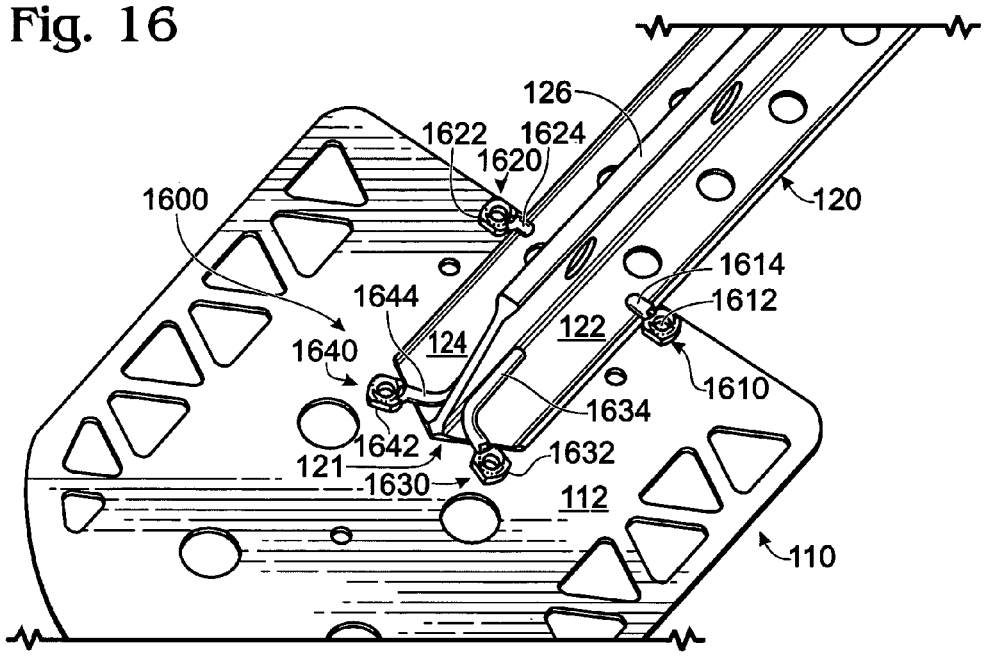
FIGS. 16 and 17 illustrate alternative examples of lip assemblies for use at the interface between the snow fluke and snow picket.

FIG. 16 illustrates another example of a lip assembly 1600 configured to receive one or more flanges of snow picket 120 and for coupling snow picket 120 to blade body 112 of snow fluke 110. Lip assembly 1600 comprises a plurality of brackets 1610, 1620, 1630, and 1640 that may each include a lip portion mounted to blade body 112 via a respective mounting portion. Lip portions 1614, 1624, 1634, and 1644 define channels with blade body 112 into which flanges 122 and 124 may be inserted and retained as previously described with reference to FIGS. 2-5. For example, lip portion 1614 may be mounted to blade body 112 via corresponding mounting portion 1612. Similarly, lip portion 1624 may include corresponding mounting portion 1622, lip portion 1634 may include corresponding mounting portion 1632, and lip portion 1642 may include corresponding mounting portion 1644. Mounting portions 1612, 1622, 1632, and 1642 may be each coupled to blade body 112 by any suitable fastener, adhesive, or weld; or brackets 1610, 1620, 1630, and 1640 may be integrally formed with blade body 112. Brackets 1610, 1620, 1630, and 1640 may comprise any suitable material including, but not limited to metal (e.g. steel, aluminum, titanium) and plastic. In some embodiments, lip portions 1614, 1624, 1634, and 1644 may include circular, ovular, or rounded cross-sections. However, rectilinear cross-sections or other suitable cross-sections may be used in other embodiments.

Figure 17:
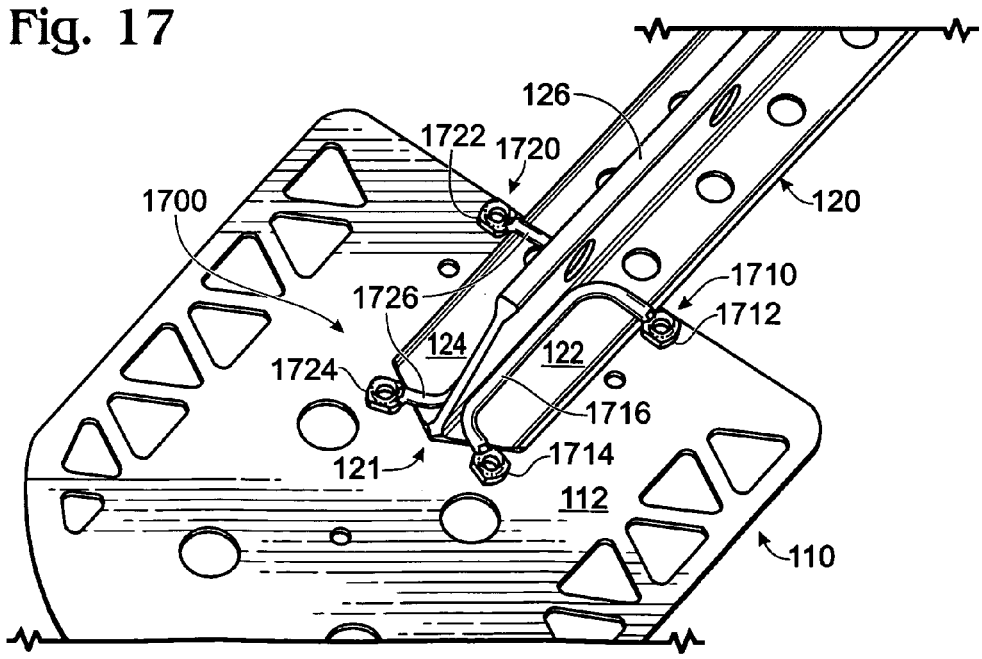

FIG. 17 illustrates yet another example of a lip assembly 1700 configured to receive one or more flanges of snow picket 120 and for coupling snow picket 120 to blade body 112 of snow fluke 110. Lip assembly 1700 is similar to lip assembly 1600 in many respects. However, in the embodiment of FIG. 17, mounting portions 1712 and 1714 of bracket 1710 share a common lip portion 1716. Similarly, mounting portions 1722 and 1724 of bracket 1720 share a common lip portion 1726. Lip portion 1716 may form a first channel with blade body 112 for receiving flange 122 and lip portion 1726 may form a second channel with blade body 112 for receiving flange 124. Brackets 1710 and 1720 may be formed from any suitable material including, but not limited to metal (e.g. steel, aluminum, or titanium) and plastic. Lip portions 1716 and 1726 may include circular, ovular, or rounded cross-sections in some embodiments. In other embodiments, lip portions 1716 and 1726 may include rectilinear cross-sections or other suitable cross-sections. Mounting portions 1712, 1714, 1722, and 1724 may be coupled with blade body 112 via any suitable fastener, adhesive, or weld; or brackets 1710 and 1720 may be integrally formed with blade body 112.

With each of lip assemblies 1600 and 1700, snow picket 120 may be confined to a region defined by the mounting portions and lip portions of the lip assemblies. For example, mounting portions 1632/1642 and mounting portions 1714/1724 may form a backstop against which nose end 121 of snow picket 120 may rest when mated with snow fluke 110, as previously described with reference to pocket 380 of FIGS. 3 and 4. Similarly, mounting portions 1612/1622 and mounting portions 1712/1722 may interface with or contact the outer edges of flanges 122 and 124 to reduce or inhibit lateral movement of the snow picket when mated with the snow fluke. In some embodiments, the lip portions may interface with or contact spine 126 to further support and strengthen interface 130. For example, lip portions 1634/1644 and lip portions 1716/1726 may contact spine 126 to reduce lateral movement or twisting movement of the snow picket relative to the snow fluke. It should be appreciated that lip assemblies 1600 and 1700 may be used in conjunction with the previously described pin assembly 1200 and/or rigging cable 180 to retain snow picket 120 in the mated configuration with snow fluke 110.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A multi-use snow tool, comprising:

a snow fluke including a blade body having a base end and a nose end opposite the base end;

a snow picket having an elongate shaft including a nose end and a tail end, the elongate shaft having a T-shaped cross-section from the nose end to the tail end, the T-shaped cross section including at least a first flange and a second flange projecting outward from a central spine; and a lip assembly located at the base end of the blade body and cooperating with the blade body to define at least a first channel and a second channel, the first channel and the second channel adapted to mate with the first flange and the second flange, respectively, to detachably couple the snow picket to the snow fluke.

2. The multi-use snow tool of claim 1, wherein the first and second channels are adapted to respectively mate with the first and second flanges at the nose end of the snow picket;

wherein the spine tapers at the nose end of the snow picket.

3. The multi-use snow tool of claim 2, wherein the snow picket further includes an end cap that substantially covers the T-shaped cross-section at the tail end of the snow picket and forms a substantially blunt surface at the tail end of the snow picket.

4. The multi-use snow tool of claim 1, further comprising a handle including a handle bar and handle body defining an opening for receiving the tail end of the snow picket.

5. The multi-use snow tool of claim 1, further comprising a rigging cable having a first end coupled to the blade body of the snow fluke and a second end adapted to be detachably coupled to the snow picket to retain the first flange and the second flange in a mated position with the first channel and the second channel, respectively.

6. The multi-use snow tool of claim 1, wherein the blade body of the snow fluke includes a central portion and two wing portions disposed on either side of the central portion, wherein the two wing portions are angled inward toward a first side of the central portion.

7. A reconfigurable multi-use snow tool, comprising:

a snow fluke including a blade body defining a plurality of openings passing through the blade body;

a snow picket defining an elongate shaft including a nose end and a tail end, the elongate shaft having a T-shaped cross-section including a first flange and a second flange projecting outward from a central spine;

a mounting bracket including a mounting surface coupled to a first outwardly facing surface of the blade body, the mounting bracket further including at least a first lip portion and a second lip portion spaced apart from the first outwardly facing surface of the blade body;

a handle including a handle body defining an opening that is adapted to detachably receive the tail end of the snow picket; and a rigging cable including a first end coupled to the snow fluke via at least one of the plurality of openings;

wherein a first inwardly facing surface of the first lip portion and the first outwardly facing surface of the blade body collectively define a first channel that is adapted to detachably receive the first flange at the nose end of the snow picket; and wherein a second inwardly facing surface of the second lip portion and the first outwardly facing surface of the blade body collectively define a second channel that is spaced apart from and opposes the first channel, wherein the second channel is adapted to detachably receive the second flange at the nose end of the snow picket;

wherein a second end of the rigging cable is configured to be coupled to the handle body to collectively retain the snow fluke, the snow picket, and the handle in a mated configuration.

8. The reconfigurable multi-use snow tool of claim 7, wherein the mounting bracket further includes a third lip portion that extends around a base end of the blade body, the third lip portion including an inwardly facing surfaces that interfaces with a second outwardly facing surface of the blade body that is disposed on an opposite side of the blade body from the first outwardly facing surface.

9. The reconfigurable multi-use snow tool of claim 7, wherein the first and second channels are adapted to receive the snow picket in the mated configuration that orientates an outer edge of the central spine in the same direction as the first outwardly facing surface of the blade body.

10. The reconfigurable multi-use snow tool of claim 7, wherein the central spine of the snow picket includes a unidirectional serrated edge extending along at least a length portion of the snow picket.

11. A reconfigurable multi-use snow tool, comprising:

a snow fluke including a blade body;

a snow picket defining an elongate shaft including a nose end and a tail end, the elongate shaft having a T-shaped cross-section including a first flange and a second flange projecting outward from a central spine, wherein the T-shaped cross-section extends along a longitudinal axis of the snow picket from the nose end of the snow picket to the tail end of the snow picket;

a mounting bracket including a mounting surface coupled to a first outwardly facing surface of the blade body, the mounting bracket further including at least a first lip portion and a second lip portion spaced apart from the first outwardly facing surface of the blade body;

wherein a first inwardly facing surface of the first lip portion and the first outwardly facing surface of the blade body collectively define a first channel that is adapted to detachably receive the first flange at a nose end of the snow picket; and wherein a second inwardly facing surface of the second lip portion and the first outwardly facing surface of the blade body collectively define a second channel that is spaced apart from and opposes the first channel, wherein the second channel is adapted to detachably receive the second flange at a nose end of the snow picket.

12. The reconfigurable multi-use snow tool of claim 11, further comprising a rigging cable including a first end coupled to the snow fluke.

13. The reconfigurable multi-use snow tool of claim 12, wherein a second end of the rigging cable is configured to be detachably coupled to the snow picket to collectively retain the snow fluke and the snow picket in a mated configuration.

* * * * *